US005986679A

United States Patent [19]

Fassler et al.

[11] Patent Number: 5,986,679

[45] **Date of Patent: *Nov. 16, 1999**

[54] MICROFLUIDIC PRINTING ARRAY VALVE WITH MULTIPLE USE PRINTING NOZZLES

[75] Inventors: Werner Fassler, Rochester; James E. Pickering, Holcomb; Charles D. DeBoer, Palmyra, all of N.Y.

[73] Assignee: Eastman Kodak Company, Rochester, N.Y.

[ * ] Notice: This patent is subject to a terminal disclaimer.

[21] Appl. No.: 08/904,090

[22] Filed: Jul. 31, 1997

[51] Int. Cl.[6] ..... B41J 2/005

[52] U.S. Cl. ..... 346/140.1

[58] Field of Search ..... 346/140.1; 347/7, 347/37, 71, 103

[56] References Cited

U.S. PATENT DOCUMENTS

| | | |
|---|---|---|
| 5,585,069 | 12/1996 | Zanzucchi et al. . |
| 5,593,838 | 1/1997 | Zanzucchi et al. . |
| 5,603,351 | 2/1997 | Cherukuri et al. . |
| 5,611,847 | 3/1997 | Guistina et al. . |

OTHER PUBLICATIONS

Dasgupta et al., see "Electroosmosis: A Reliable Fluid Propulsion System for Flow Injection Analyses", Anal. Chem. 66, pp. 1792–1798 (1994).

*Primary Examiner*—N. Le
*Assistant Examiner*—Lamson D. Nguyen
*Attorney, Agent, or Firm*—Raymond L. Owens

[57] ABSTRACT

A microfluidic printing apparatus includes at least one ink reservoir; a moveable plate having a plurality of delivery chambers in an array each for forming an ink pixel, and a plurality of microchannels connecting the reservoir to a delivery chamber; and a plurality of microfluidic pumps each being associated with a single microchannel for supplying ink to particular delivery chambers. The moveable plate moves between different positions for permitting the delivery chambers for sequentially delivering ink from an associated microchannel into its associated delivery chamber to control the amount of ink delivered to each delivery chamber; and a computer for controlling the microfluidic pumps and the movement of the moveable shutter plate for causing the correct amount of ink to be conveyed into each delivery chamber.

3 Claims, 8 Drawing Sheets

MICROFLUIDIC PRINTING ARRAY VALVE WITH MULTIPLE USE PRINTING NOZZLES

CROSS REFERENCE TO RELATED APPLICATIONS

The present invention is related to U.S. patent application Ser. No. 08/868,426 filed Jun. 3, 1997, entitled "Continuous Tone Microfluidic Printing" to DeBoer, Fassler, and Wen; U.S. patent application Ser. No. 08/868,416 filed Jun. 3, 1997 entitled "Microfluidic Printing on Receiver", to DeBoer, Fassler, and Wen; U.S. patent application Ser. No. 08/868,102 filed Jun. 3, 1997 entitled "Microfluidic Printing with Ink Volume Control" to Wen, DeBoer, and Fassler; U.S. patent application Ser. No. 08/868,477 filed Jun. 3, 1997 entitled "Microfluidic Printing with Ink Flow Regulation" to Wen, Fassler, and DeBoer, U.S. patent application Ser. No. 08/903,747 filed concurrently herewith entitled "Microfluidic Printing Array Valve" to Fassler, Pickering and DeBoer, all assigned to the assignee of the present invention. The disclosure of these related applications is incorporated herein by reference.

FIELD OF THE INVENTION

The present invention relates to printing high quality images by microfluidic pumping of inks into receivers such as paper.

BACKGROUND OF THE INVENTION

Microfluidic pumping and dispensing of liquid chemical reagents is the subject of three U.S. Pat. Nos. 5,585,069; 5,593,838; and 5,603,351, all assigned to the David Sarnoff Research Center, Inc. The system uses an array of micron sized reservoirs, with connecting microchannels and reaction cells etched into a substrate. Electrokinetic pumps comprising electrically activated conductors within the capillary microchannels provide the propulsive forces to move the liquid reagents within the system. The electrokinetic pump, which is also known as an electroosmotic pump, has been disclosed by Dasgupta et al., see "Electroosmosis: A Reliable Fluid Propulsion System for Flow Injection Analysis", Anal. Chem. 66, pp 1792–1798 (1994). The chemical reagent solutions are pumped from a reservoir, mixed in controlled amounts, and them pumped into a bottom array of reaction cells. The array may be decoupled from the assembly and removed for incubation or analysis. When used as a printing device, the chemical reagent solutions are replaced by dispersions of cyan, magenta, and yellow pigment, and the array of reaction cells may be considered a viewable display of picture elements, or pixels, comprising mixtures of pigments having the hue of the pixel in the original scene. When contacted with paper, the capillary force of the paper fibers pulls the dye from the cells and holds it in the paper, thus producing a paper print, or photograph, of the original scene. One problem with this kind of printer is the accurate control of the print density. The problem comes about because the capillary force of the paper fibers is strong enough to remove all the ink from the device, draining it empty. If the paper is not removed from contact with the ink cells at the correct time, the print density will be too high or too low. Moreover, the correct paper contact time varies with the ambient temperature, making the timing problem more difficult One solution to this problem is given in the above mentioned copending U.S. patent application Ser. No. 08/868,416, where a special paper is employed which will absorb only a limited amount of ink. Nevertheless, it would be cheaper if plain paper can be employed for this kind of printing. Another solution to this problem is given in the above mentioned copending U.S. patent application Ser. No. 08/903,747, wherein an array of microvalves, each individually addressed, controls the flow of ink to the paper. The complexity of individually addressed valves leads to a high cost printing apparatus. In would be cheaper and easier to manufacture a device that did not have to many individually addressed valves. A problem with microfluidic ink printers is that they can leak ink when not in the printing condition, and further that the ink can be contaminated by the outside environment causing degradation in properties.

SUMMARY OF THE INVENTION

It is an object of this invention to provide a microfluidic printer which can rapidly print a high quality image on receivers such as plain paper without ink leakage or ink contamination by the environment Another object of this invention is to provide a compact, low power, portable printer.

These objects are achieved by a microfluidic printing apparatus comprising:

a) at least one ink reservoir;

b) a moveable plate having a plurality of delivery chambers in an array each for forming an ink pixel, and a plurality of microchannels connecting the reservoir to a delivery chamber;

c) a plurality of microfluidic pumps each being associated with a single microchannel for supplying ink to particular delivery chambers;

d) means for moving the moveable plate between different positions for permitting the delivery chambers for sequentially delivering ink from an associated microchannel into its associated delivery chamber to control the amount of ink delivered to each delivery chamber; and e) control means for controlling the mnicrofluidic pumps and the movement of the moveable shutter plate for causing the correct amount of ink to be conveyed into each delivery chamber.

ADVANTAGES

A feature of the present invention is that it provides an apparatus which produces high quality prints of the correct density on plain paper.

A further feature of the invention is that the apparatus, in accordance with the present invention, prevents the outside environment from acting on inks to degrade their properties.

Another feature of the invention is that the printer is low power, compact and portable.

Another feature of the invention is that the printing process is fast, because all the pixels are printing simultaneously.

Another feature of the invention is that the printer is of low cost to manufacture, because a single actuator serves to actuate all the pixel valves simultaneously.

Another feature of the invention is that more than one color ink is printed with a single printing nozzle.

Another feature of the invention is that the printer is of low cost to manufacture, because fewer electrical connections are needed.

DETAILED DESCRIPTION OF THE INVENTION

The present invention is described in relation to a microfluidic printing apparatus which can print computer generated images, graphic images, line art, text images and the like, as well as continuous tone images.

Figure 1:
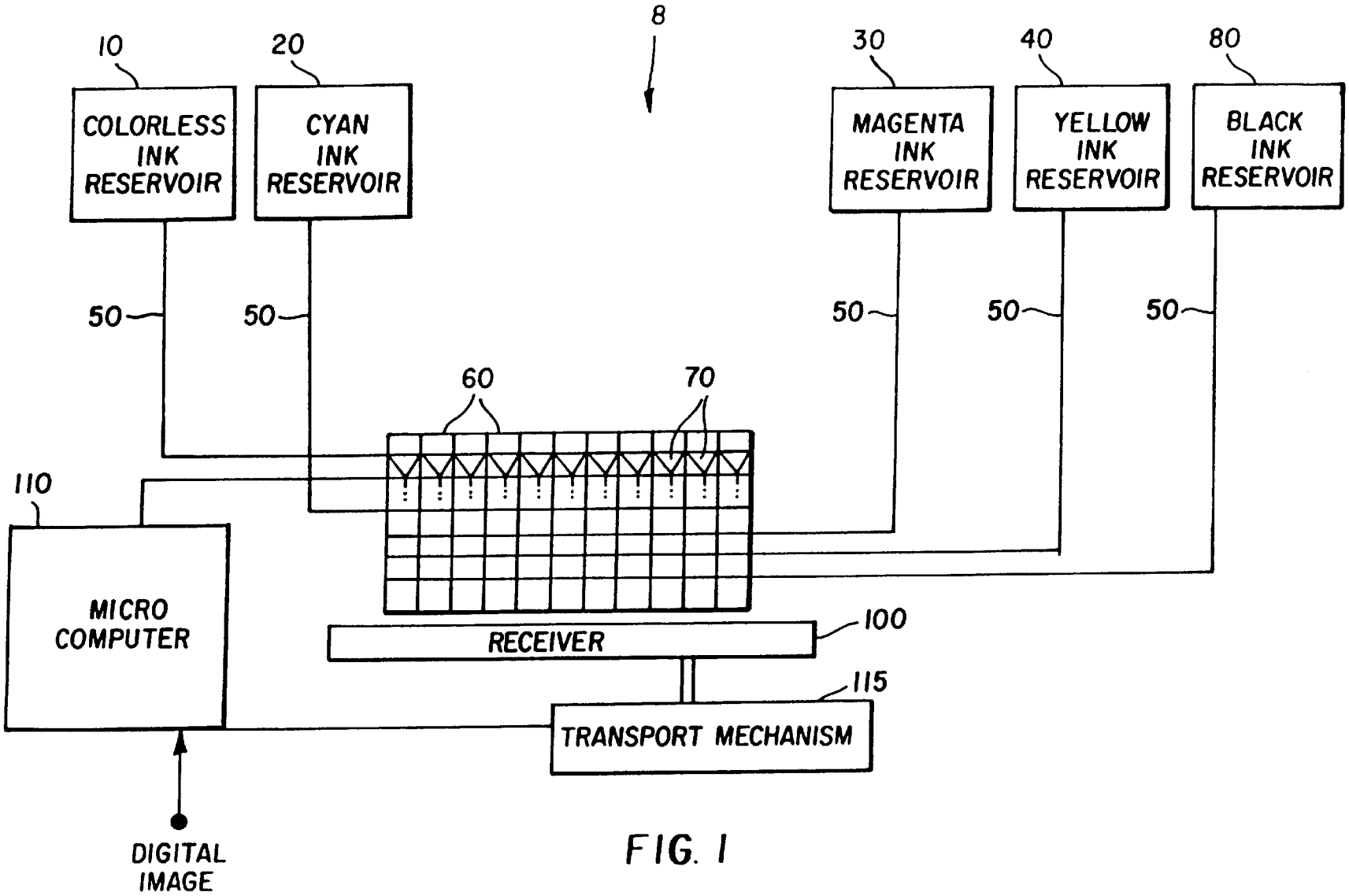
FIG. 1 is a partial schematic showing a microfluidic printing system for printing a digital image on a reflective receiver.

Referring to FIG. 1, a schematic diagram is shown of a printing apparatus 8 in accordance with the present invention. Reservoirs 10, 20, 30, and 40 are respectively provided for holding colorless ink, cyan ink, magenta ink, and yellow ink. An optional reservoir 80 is shown for black ink. Microchannel capillaries 50 respectively connected to each of the reservoirs conduct ink from the corresponding reservoir to an array of ink mixing chambers 60. In the present invention, the ink mixing chambers 60 deliver the inks directly to a receiver; however, other types of ink delivery arrangements can be used such as microfluidic channels, and so when the word chamber is used, it will be understood to include those arrangements. The colored inks are delivered to ink mixing chambers 60 by electrokinetic pumps 70. The amount of each color ink is controlled by microcomputer 110 according to the input digital image. For clarity of illustration, only one set of electrokinetic pumps is shown for the colorless ink channel. Similar pumps are used for the other color channels, but these are omitted from the figure for clarity. Finally, a reflective receiver 100 is transported by a transport mechanism 115 to come in contact with the microfluidic printing apparatus. The receiver 100 receives the ink and thereby produces the print. Receivers may include common bond paper, made from wood fibers, as well as synthetic papers made from polymeric fibers. In addition the receiver can be of non-fibrous construction, provided the receiver will absorb and hold the ink used in the printer.

Figure 2:
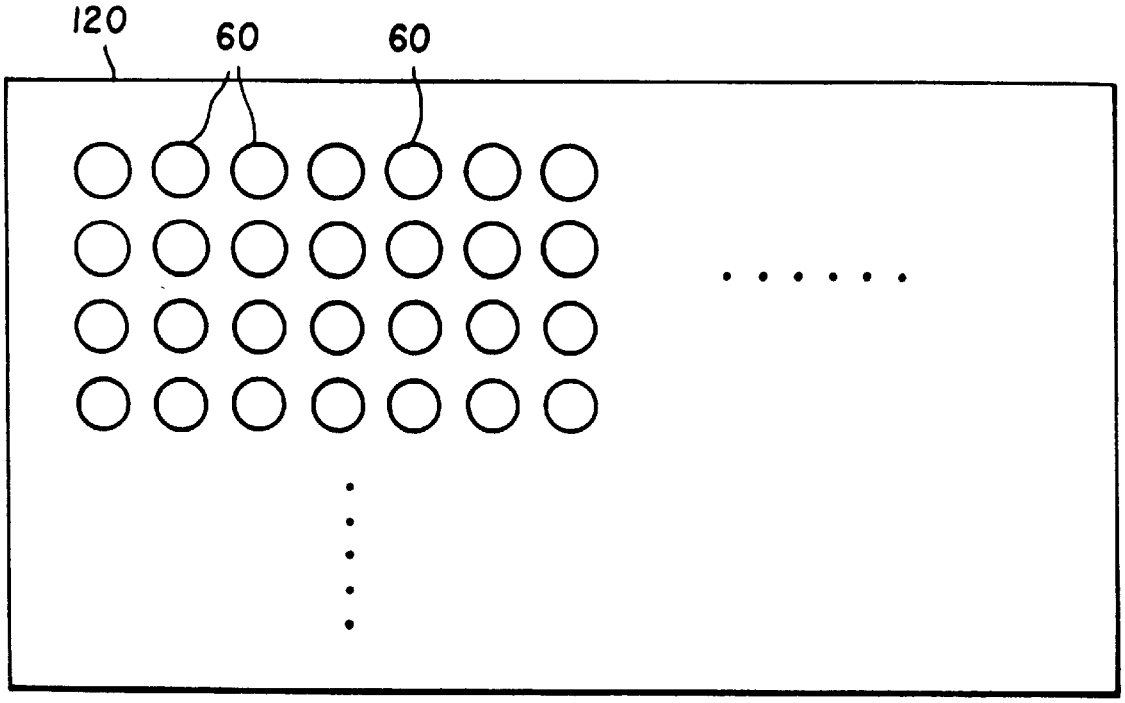
FIG. 2 is a top view of a pattern of the color pixels which can be produced by an apparatus in accordance with the present invention.

FIG. 2 depicts a top view of an arrangement of mixing chambers 60 shown in FIG. 1. Each ink mixing chamber 60 is capable of producing a mixed ink having any color saturation, hue and lightness within the color gamut provided by the set of cyan, magenta, yellow, and colorless inks used in the apparatus.

The inks used in this invention are dispersions of colorants in common solvents. Examples of such inks may be found is U.S. Pat. No. 5,611,847 by Gustina, Santilli, and Bugner. Inks may also be found in the following commonly assigned U.S. patent application Ser. No. 08/699,955 filed Aug. 20, 1996; U.S. patent application Ser. No. 08/699,962 filed Aug. 20, 1996; and U.S. patent application Ser. No. 08/699,963 filed Aug. 20, 1996 by McInerney, Oldfield, Bugner, Bermel, and Santilli; and in U.S. patent application Ser. No. 08/790,131 filed Jan. 29, 1997 by Bishop, Simons, and Brick; and in U.S. patent application Ser. No. 08/764,379 filed Dec. 13, 1996 by Martin. In a preferred embodiment of the invention the solvent is water. Colorants such as the Ciba Geigy Unisperse Rubine 4BA-PA, Unisperse Yellow RT-PA, and Unisperse Blue GT-PA are also preferred embodiments of the invention. The colorless ink of this invention is the solvent for the colored inks in the most preferred embodiment of the invention.

The microchannel capillaries, ink pixel mixing chambers and microfluidic pumps are more fully described in the references listed above.

Figure 3:
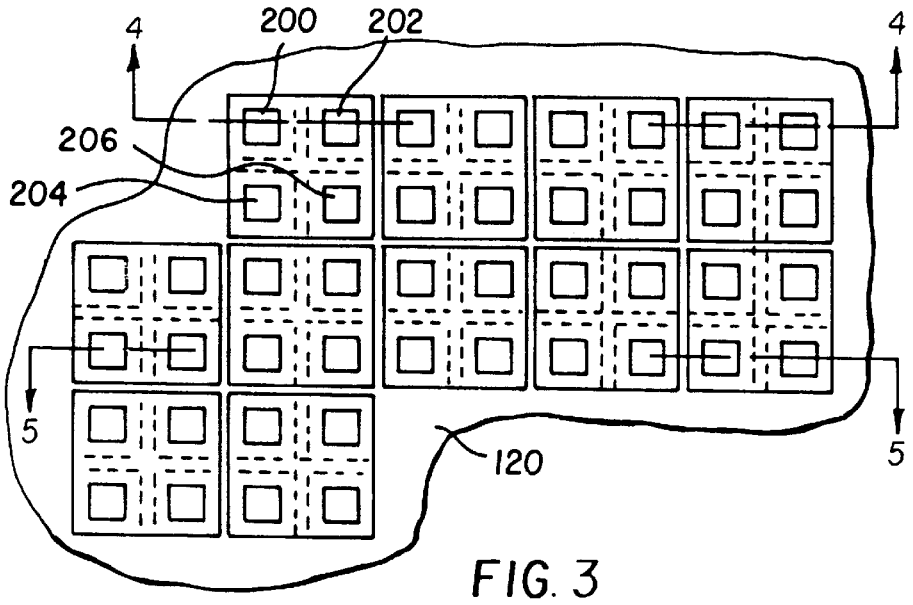
FIG. 3 is a top view of a second pattern of the color pixels which can be produced by an apparatus in accordance with the present invention.

FIG. 3 illustrates the arrangement of a second pattern of color pixels in the present invention. The ink mixing chambers 60 are fed by four microchannels of different colors; cyan ink orifice 200; magenta ink orifice 202; yellow ink orifice 204; and black ink orifice 206. Each orifice is connected only to the respective colored ink reservoir and to the colorless ink reservoir 10. For example, the cyan ink orifice 200 is connected to the cyan ink reservoir and the colorless ink reservoir so that cyan inks can be mixed to any desired lightness. When the inks are transferred to the reflective receiver 100 some of the inks can mix and blend on the receiver. Inasmuch as the inks are in distinct areas on the receiver, the size of the printed pixels should be selected to be small enough so that the human eye will integrate the color and the appearance of the image will be that of a continuous tone photographic quality image.

Figure 4:
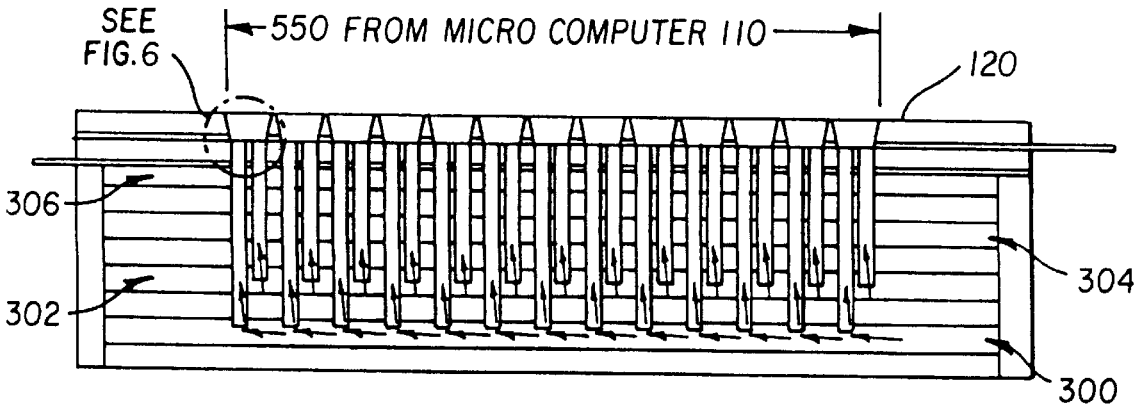
FIG. 4 is a cross-sectional view taken along the lines 4—4 of the microfluidic printing apparatus in FIG. 3.
Figure 5:
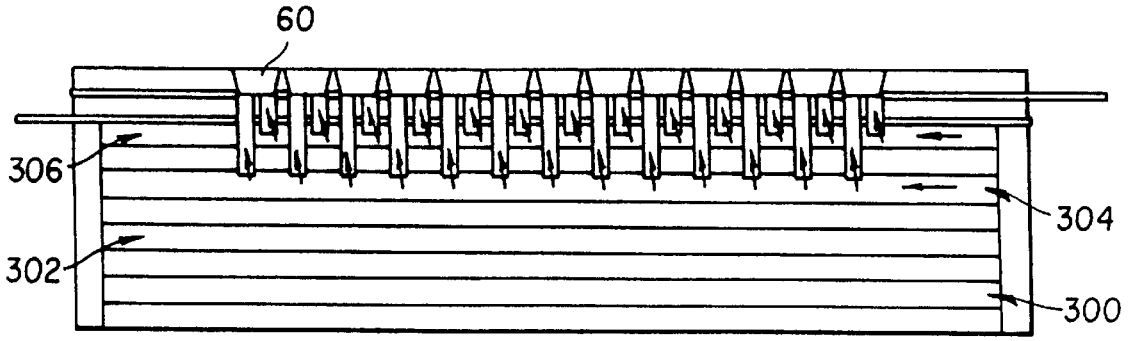
FIG. 5 is another cross-section taken along the lines 5—5 of the microfluidic printing apparatus in FIG. 3.

Cross-sections of the color pixel arrangement shown in FIG. 3 are illustrated in FIG. 4 and FIG. 5. The colored ink supplies 300, 302, 304, and 306 are fabricated in channels parallel to the printer front plate 120. The cyan, magenta, yellow and black inks are respectively delivered by colored ink supplies 300, 302, 304, and 306 into each of the colored ink mixing chambers.

Figure 6:
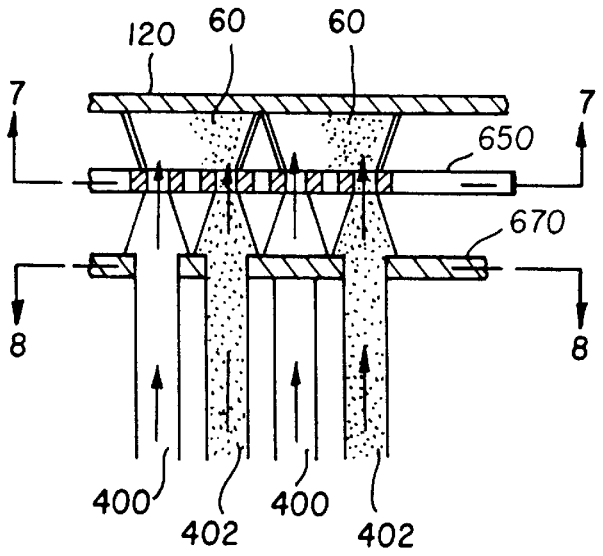
FIG. 6 is an enlarged view of the circled portion of FIG. 4.
Figure 8:
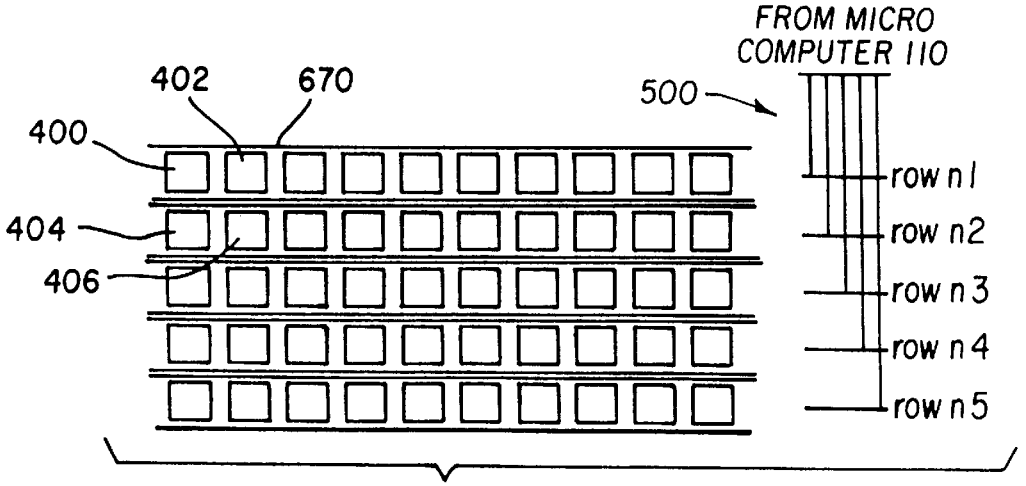
FIG. 8 is a top view of the microchannel and showing conducting circuit connections in FIG. 6.

A detailed view of the cross-section in FIG. 4 is illustrated in FIG. 6. The colored inks are delivered to the ink mixing chambers respectively by cyan, magenta, yellow, and black ink microchannels 400, 402, 404, and 406 (404 and 406 do not show up in the plan shown in FIG. 6, but is illustrated in FIG. 8). The colored ink microchannels 400, 402, 404, and 406 are respectively connected to the colored ink supplies 300, 302, 304, and 306 (FIGS. 4 and 5). The colorless ink is supplied to the ink mixing chamber, but is not shown in FIG. 6 for clarity of illustration.

Figure 7:
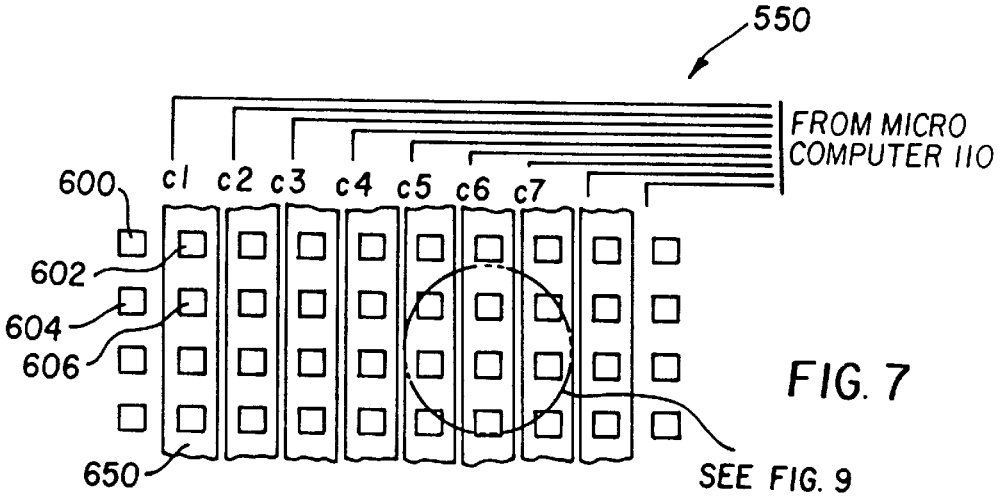
FIG. 7 is a top view of the micronozzles shown in FIG. 6.

A cross-section view of the plane containing the micronozzles in FIG. 6 is shown in FIG. 7. The cyan, magenta, yellow, and black ink micronozzles 600, 602, 604, and 606 are distributed in the same arrangement as the colored ink supply lines 300–304 and the termination of the chambers 60 which are colored ink orifices 200–206. Column connectors 650 are shown connected to the conducting circuit 550, which is further connected to microcomputer 110.

A cross-section view of the plane containing the microchannels in FIG. 6 is shown in FIG. 8. The color ink channels 400–406 are laid out in the spatial arrangement that corresponds to those in FIGS. 3 and 7. Lower conductors in the electrokinetic pumps for delivering the colored inks are not shown for clarity of illustration. Row conductors 670 are connected to lower conductors of the electrokinetic pumps. The row conductors 670 are shown connected to the conducting circuit 500, which is further connected to microcomputer 110.

Figure 9:
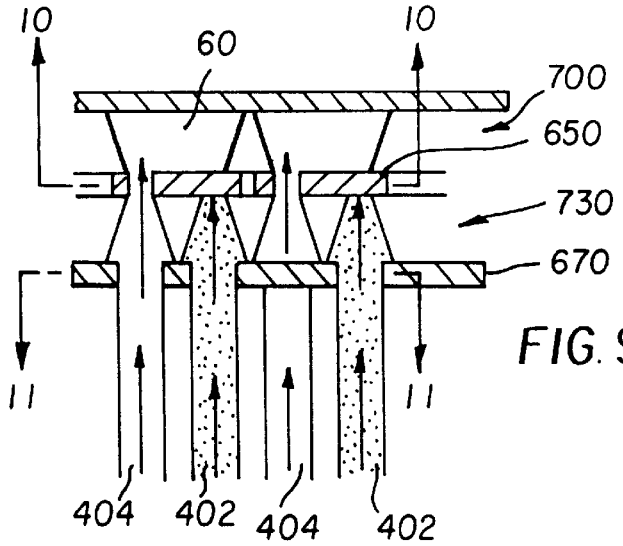
FIG. 9 is a cross sectional view of the moveable shutter plate showing how the "on" position for one ink is the "off" position for a second color ink.
Figure 10:
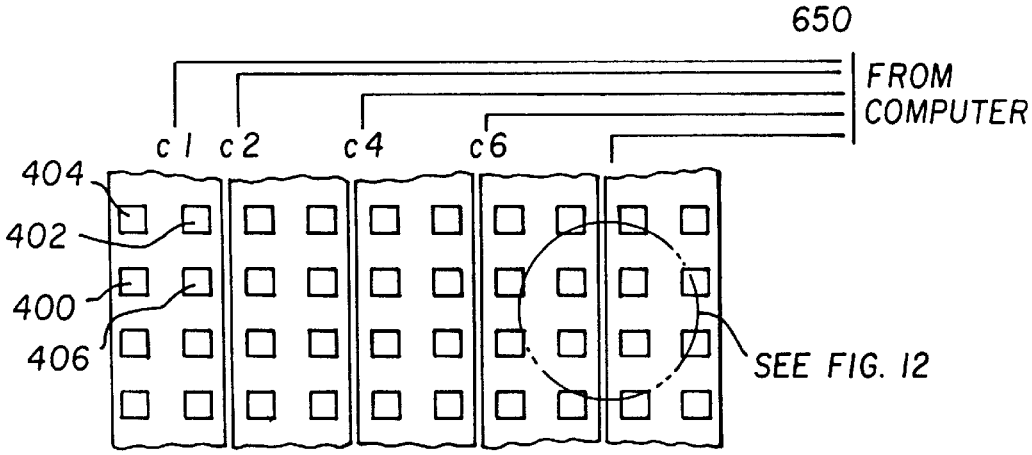
FIG. 10 is a top view of the bottom plane of the moveable shutter plate of FIG. 9 showing the conducting circuit connections to the computer.
Figure 11:
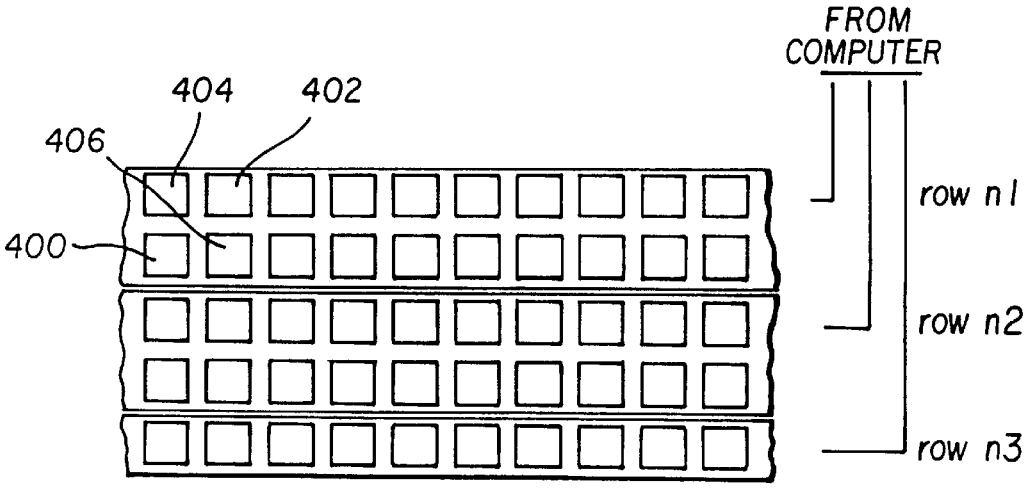
FIG. 11 is a top view of the top plane of the moveable shutter plate of FIG. 9 showing the conducting circuit connections to the computer.
Figure 12:
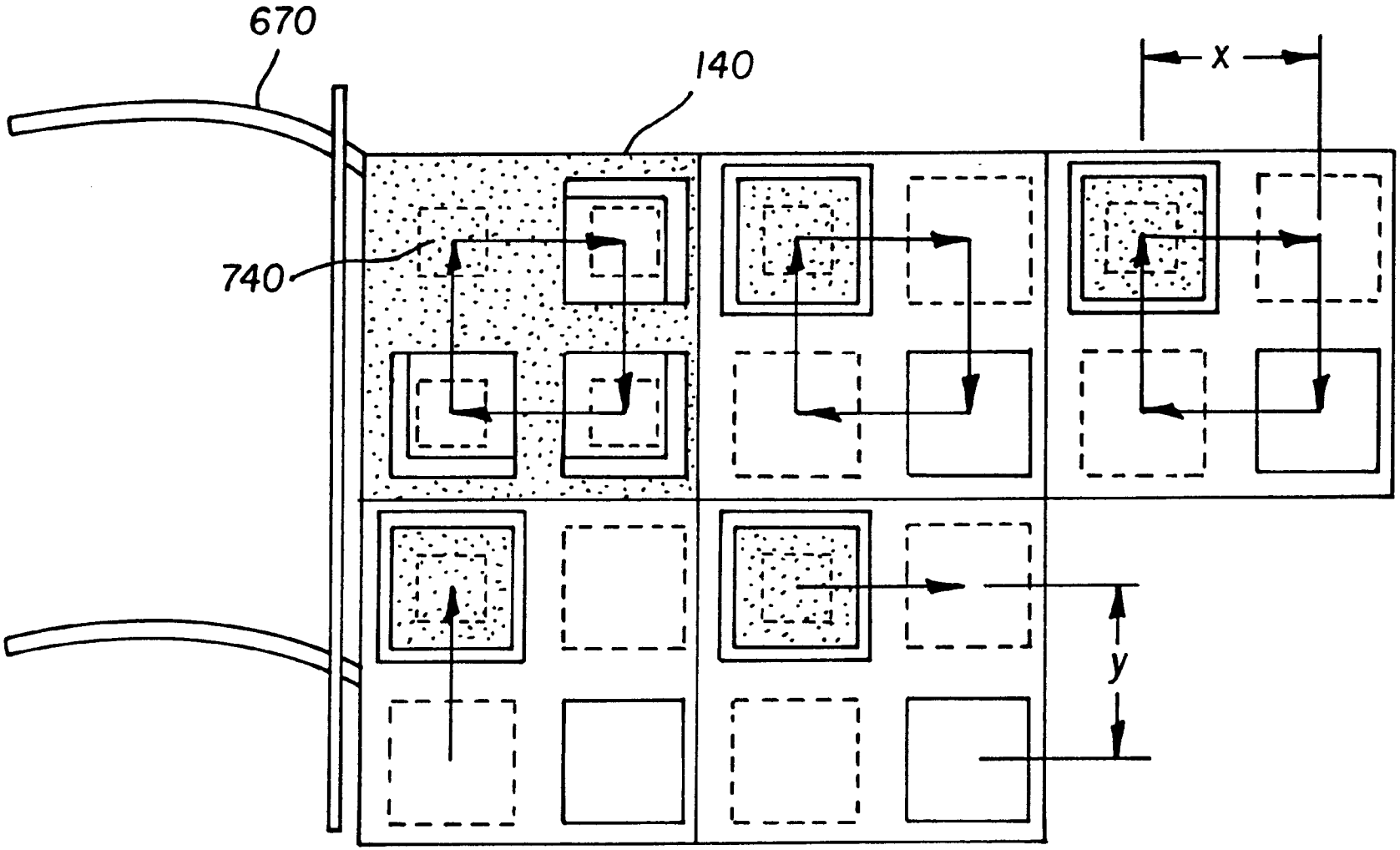
FIG. 12 is an expanded top view of the moveable shutter plate of FIG. 10 showing a moving pattern wherein a single micronozzle may be used to print four different colored ink pixels.
Figure 13:
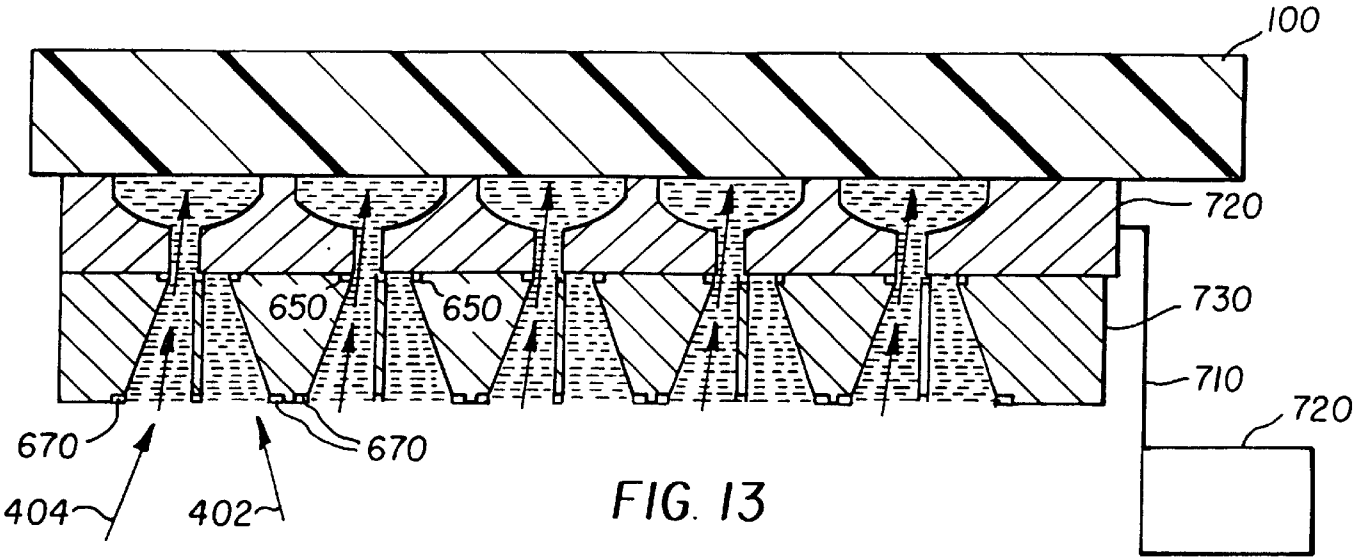
FIG. 13 is a cross sectional view of the moveable shutter plate showing a first color ink entering a mixing chamber prior to printing.
Figure 14:
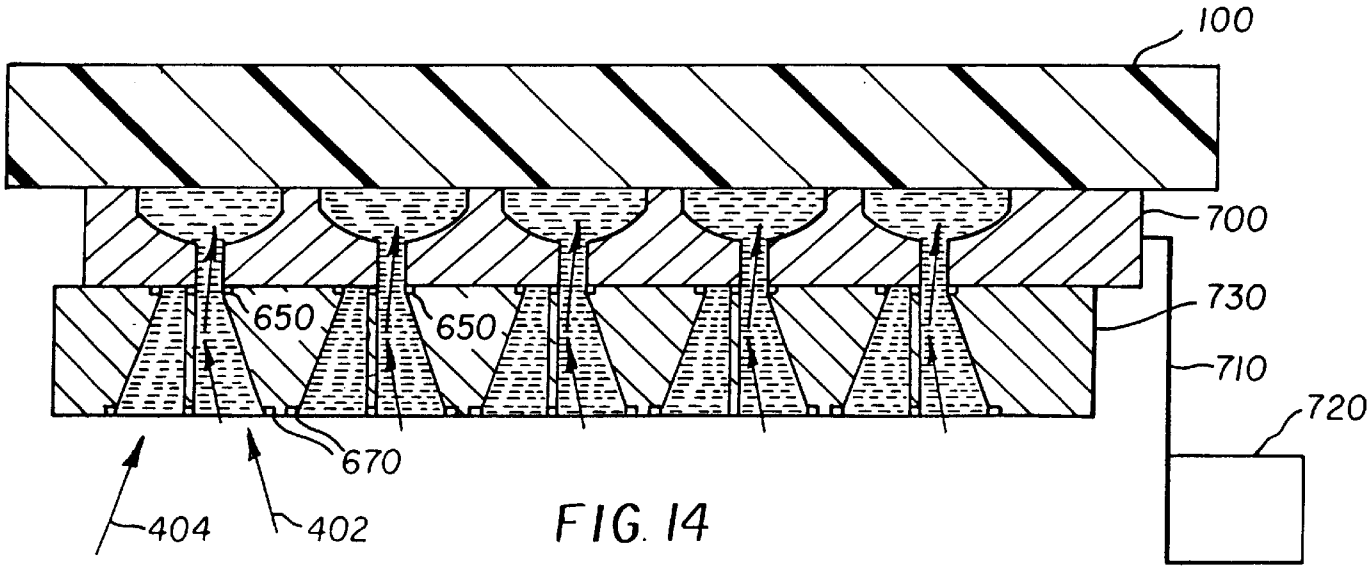
FIG. 14 is a cross sectional view of the moveable shutter plate showing a second color ink entering a mixing chamber prior to printing.
Figure 15:
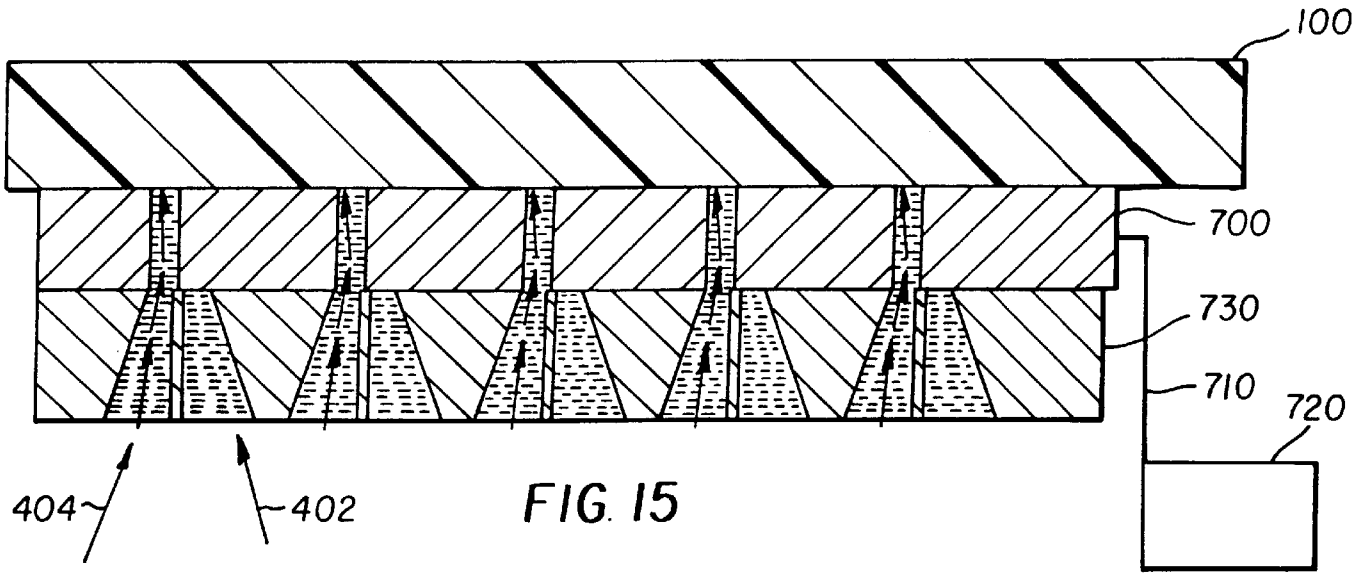
FIG. 15 is a cross sectional view of a moveable shutter plate showing a first color ink being printed into the receiver without recourse to a mixing chamber.
Figure 16:
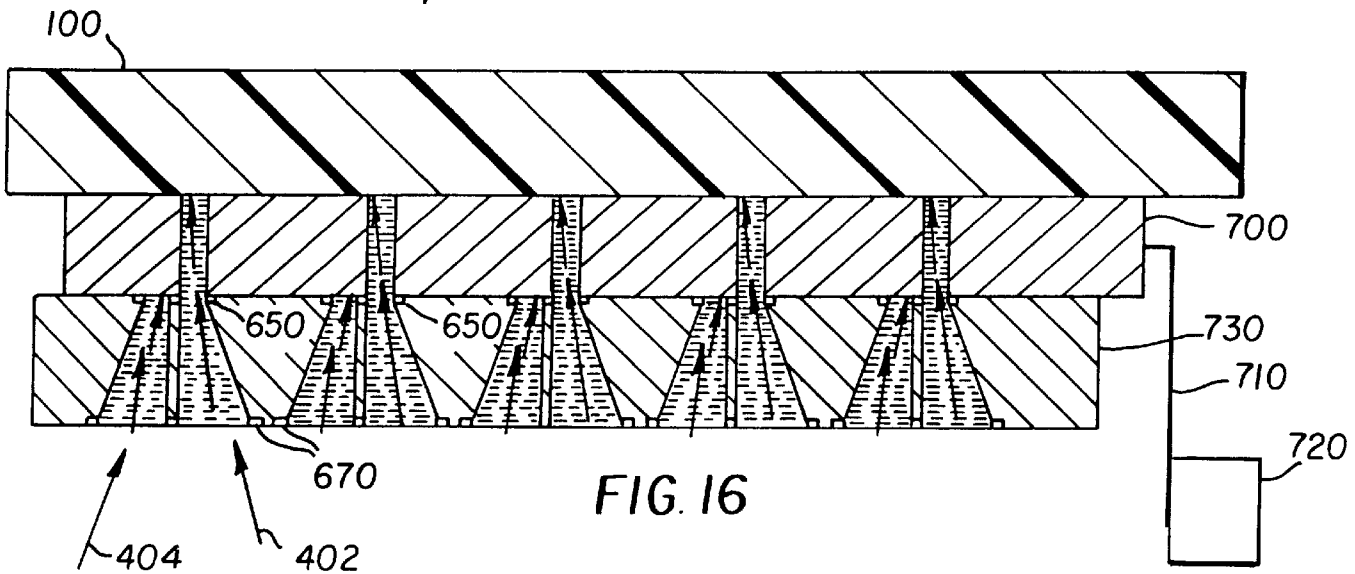
FIG. 16 is a cross sectional view of a moveable shutter plate showing a second color ink being printed into the receiver without recourse to a mixing chamber.

FIG. 9 illustrates the preferred embodiment of the invention. A moveable shutter plate 700 having a single orifice 740 for each pixel area is disposed contiguously over an ink supply plate 730. At the beginning of the printing operation ink flows from the yellow ink microchannel 404 in response to the electrokinetic pump through the ink orifice 740 into the ink mixing chamber 60. When the correct amount of ink has been delivered to the mixing chamber, the shutter plate is moved to the next microchannel in the direction and by the distance indicated by vector "x", as shown in FIG. 12, which shows a top view of the pixel area 140. After the delivery of the ink from the second microchannel, the shutter plate is moved again by the distance and direction indicated by the vector "y" to the third microchannel. The fourth color ink is delivered in the same way. Since three of the microchannels are blocked when the orifice 740 is open to one of the microchannels, a single column conductor and a single row conductor can be used to control all four colors of ink. As FIG. 12 shows, only 2 electrical connections are needed per pixel, which saves both real estate and manufacturing costs. When current is supplied to pump the ink of the open microchannel, pressure will be developed in the three closed microchannels, but no ink will flow because the microchannels are closed. The use of a single conductor for all four colors greatly simplifies the construction of the circuits of the printer. The row and column conductors are shown in FIGS. 10 and 11, which are top views of the lines 10—10 and 11—11 shown in FIG. 9. FIG. 13 shows an embodiment of the invention where mixing chambers are used to collect the ink from different ink microchannels before transferring the ink to paper, as described above. FIG. 13 also shows the arrangement of the actuator 720 and mechanical linkage 710 which control the opening and closure of the shutter plate 700. FIG. 13 shows the flow of ink of the first color through the orifice 740, while FIG. 14 shows the flow of ink of the second color through the orifice after movement of the shutter plate 700. FIGS. 15 and 16 show a different embodiment of the invention in which there are no mixing chambers. In this case the ink flows through the orifice 740 directly to the paper. If the printed dots of color are small enough, the human eye will integrate them into a single color of the correct hue and intensity of the original scene.

The invention has been described in detail with particular reference to certain preferred embodiments thereof, but it will be understood that variations and modifications can be effected within the spirit and scope of the invention.

PARTS LIST

8 microfluidic printing system
10 colorless ink reservoir
20 cyan ink reservoir
30 magenta ink reservoir
40 yellow ink reservoir
50 microchannel capillaries
60 ink mixing chambers, or printing nozzles
70 electrokinetic pumps
80 black ink reservoir
100 receiver
110 microcomputer
115 transport mechanism
120 printer front plate
140 pixel area
200 cyan ink orifice
202 magenta ink orifice
204 yellow ink orifice
206 black ink orifice
300 cyan ink supply
302 magenta ink supply
304 yellow ink supply
306 black ink supply
400 cyan ink microchannel
402 magenta ink microchannel
404 yellow ink microchannel
406 black ink microchannel
500 conducting circuit
550 conducting circuit PARTS LIST (con't)

600 cyan ink micro-orifice
602 magenta ink micro-orifice
604 yellow ink micro-orifice
606 black ink micro-orifice
650 column conductors
670 row conductors
700 moveable shutter plate
710 mechanical linkage
720 actuator
730 ink supply plate
740 ink orifice

What is claimed is:

1. A microfluidic printing apparatus comprising:

a) at least one ink reservoir;

b) a moveable shutter plate having a plurality of delivery chambers in an array each for forming an ink pixel, and a plurality of microchannels connecting said at least one ink reservoir to a delivery chamber of said plurality of delivery chambers;

c) a plurality of microfluidic pumps each being associated with a single microchannel of said plurality of microchannels for supplying ink to particular delivery chambers of said plurality of delivery chambers;

d) means for moving the moveable shutter plate between different positions for permitting said delivery chambers for sequentially delivering said ink from an associated microchannel of said plurality of microchannels into its associated delivery chamber of said plurality of delivery chambers to control an amount of ink delivered to each delivery chamber of said plurality of delivery chambers; and e) control means for controlling said plurality of microfluidic pumps and the movement of the moveable shutter plate for causing the correct amount of ink to be conveyed into each delivery chamber of said plurality of delivery chambers.

2. A microfluidic printing apparatus comprising:

a) a plurality of colored ink reservoirs;

b) a moveable shutter plate having a plurality of delivery chambers defining an array each for forming an ink pixel, and a plurality of microchannels for supplying colored inks to selected delivery chambers of said plurality of delivery chambers;

c) a plurality of micropumps each being associated with a single microchannel of said plurality of microchannels for supplying said colored ink to a particular delivery chamber of said plurality of delivery chambers;

d) means for moving the moveable shutter plate between different positions for permitting said plurality of delivery chambers for sequentially delivering ink from an associated microchannel of said plurality of microchannels into its associated delivery chamber of said plurality of delivery chambers; and e) control means for controlling said plurality of microfluidic pumps and the movement of the moveable shutter plate for causing the correct amount of ink to be conveyed into each delivery chamber of said plurality of delivery chambers.

3. A microfluidic printing apparatus comprising:

a) a plurality of colored ink reservoirs;

b) a moveable shutter plate having a plurality of delivery chambers defining an array each for forming an ink pixel, and a plurality of microchannels for supplying colored inks to selected delivery chambers of said plurality of delivery chambers;

c) a plurality of microfluidic pumps each being associated with a single microchannel of said plurality of microchannels for supplying said colored ink to a particular delivery chamber of said plurality of delivery chambers;

d) means for moving the moveable shutter plate between different positions for permitting said plurality of delivery chambers to sequentially delivery ink from an associated microchannel of said plurality of microchannels into its associated delivery chamber of said plurality of delivery chambers to control an amount of ink delivered to each delivery chamber of said plurality of delivery chambers; and e) control means including a computer and electrical connections arranged in rows and columns for selectively energizing said plurality of microfluidic pumps, for controlling such pumps and the movement of the moveable shutter plate for causing the correct amount of ink to be conveyed into each delivery chamber of said plurality of delivery chambers.

* * * * *